US008152703B1

(12) United States Patent
Hinds et al.

(10) Patent No.: US 8,152,703 B1
(45) Date of Patent: Apr. 10, 2012

(54) EXERCISE DEVICE PROVIDING VARIABLE LIFT ASSISTANCE DURING PULL-UP AND PUSH-UP EXERCISES

(75) Inventors: Robert S. Hinds, Madison, WI (US); Ray Rollins, Verona, WI (US); Glenn Polinsky, Waunakee, WI (US); John Stephenson, Madison, WI (US)

(73) Assignee: Robert S. Hinds, Madison, WI (US)

( * ) Notice: Subject to any disclaimer, the term of this patent is extended or adjusted under 35 U.S.C. 154(b) by 0 days.

(21) Appl. No.: 12/914,276

(22) Filed: Oct. 28, 2010

Related U.S. Application Data

(60) Provisional application No. 61/256,360, filed on Oct. 30, 2009.

(51) Int. Cl.
*A63B 21/02* (2006.01)
*A63B 26/00* (2006.01)

(52) U.S. Cl. ..... 482/122; 482/143

(58) Field of Classification Search ..... 482/43, 482/122, 124, 129, 141, 143, 904
See application file for complete search history.

(56) References Cited

U.S. PATENT DOCUMENTS

| | | | | |
|---|---|---|---|---|
| 631,486 | A | 8/1899 | Fischer | |
| 679,784 | A * | 8/1901 | Ryan | 482/129 |
| 2,442,266 | A | 5/1948 | Davis | |
| 2,511,579 | A | 6/1950 | George | |
| D171,045 | S | 12/1953 | Noe | |
| D188,897 | S | 9/1960 | Prete, Jr. | |
| 2,998,626 | A | 9/1961 | Prete, Jr. | |
| 3,020,612 | A | 2/1962 | Meeker | |
| 3,165,805 | A | 1/1965 | Lower | |
| 3,608,158 | A | 9/1971 | Bengtsson | |
| 3,678,542 | A | 7/1972 | Prete, Jr. | |
| 3,825,252 | A * | 7/1974 | Geiger | 482/129 |
| 3,852,855 | A | 12/1974 | Bengtsson | |
| 3,863,303 | A | 2/1975 | Armstrong et al. | |
| 4,304,402 | A * | 12/1981 | Ripp | 482/125 |
| 4,328,964 | A * | 5/1982 | Walls | 482/129 |
| D274,861 | S | 7/1984 | Lindblad | |
| 4,567,628 | A | 2/1986 | Prete, Jr. et al. | |
| 4,685,671 | A * | 8/1987 | Hagerman et al. | 482/124 |

(Continued)

OTHER PUBLICATIONS http://www.gofit.net/assisted-chin-up-station.php.

(Continued)

*Primary Examiner* — Allana Lewin
(74) *Attorney, Agent, or Firm* — Craig A. Fieschko, Esq.; DeWitt Ross & Stevens S.C.

(57) ABSTRACT

An exemplary exercise device descending from an elevated support (e.g., a bar or door frame) allows a user to insert a body part in a loop (e.g., a foot for pull-ups or a waist for push-ups) descending from an elastic resistance unit, which uses a variable number of stretchable elastic members between top and bottom connectors to reduce the effective weight the user has to pull/push up. Each of the resistance unit top and bottom connectors has several elastic member sockets, each socket having a socket passage extending through the connector. Each elastic member has an elongated portion between two member plugs sized to resist passing through the elastic member socket passages. Elastic members can be removably and replaceably installed by inserting a portion of each member plug within an elastic member socket, one member plug in each of the resistance unit top and bottom connectors.

27 Claims, 4 Drawing Sheets

U.S. PATENT DOCUMENTS

| | | | | |
|---|---|---|---|---|
| 4,918,790 | A | 4/1990 | Cirket et al. | |
| 4,942,647 | A | 7/1990 | Wallner | |
| D333,640 | S | 3/1993 | Keller | |
| 5,301,911 | A | 4/1994 | Beauchemin | |
| 5,345,947 | A | 9/1994 | Fisher | |
| 5,469,583 | A | 11/1995 | Akeley et al. | |
| 5,695,101 | A | 12/1997 | Frietze | |
| 5,885,196 | A * | 3/1999 | Gvoich | 482/125 |
| 5,893,199 | A | 4/1999 | Anscher | |
| 5,941,802 | A | 8/1999 | Kiser | |
| 6,151,758 | A * | 11/2000 | Chiu | 16/443 |
| 6,348,026 | B1 | 2/2002 | Kuo | |
| 6,360,747 | B1 | 3/2002 | Velarde et al. | |
| 6,371,346 | B1 | 4/2002 | Sharma | |
| 6,497,641 | B1 | 12/2002 | Hinds | |
| 6,663,544 | B2 | 12/2003 | Hinds | |
| 6,676,576 | B1 * | 1/2004 | Wu | 482/126 |
| 6,779,280 | B2 * | 8/2004 | Wright et al. | 36/7.7 |
| 6,923,750 | B1 | 8/2005 | Hinds | |
| 6,941,620 | B1 * | 9/2005 | Hinds | 24/134 R |
| 7,147,592 | B2 | 12/2006 | Hinds | |
| 7,316,636 | B1 | 1/2008 | Hinds | |
| 7,377,886 | B2 * | 5/2008 | Wu | 482/126 |
| 7,625,324 | B1 | 12/2009 | Hinds | |
| 7,798,945 | B2 * | 9/2010 | Ko | 482/126 |
| 2001/0045548 | A1 | 11/2001 | Landy | |
| 2009/0291768 | A1 * | 11/2009 | Habing | 472/110 |

OTHER PUBLICATIONS http://www.v-tapershaper.com/vtschinpullupassist.html.
http://www.sportime.com/sportime-shared/productIndex.jsp?product=Pull-Up-Assistant.
Sportime Pull-Up Assistant Instruction Guide (1997).

* cited by examiner

EXERCISE DEVICE PROVIDING VARIABLE LIFT ASSISTANCE DURING PULL-UP AND PUSH-UP EXERCISES

CROSS-REFERENCE TO RELATED APPLICATION

This application claims priority under 35 USC §119(e) to U.S. Provisional Patent Application 61/256,360 filed Oct. 30, 2009, the entirety of which is incorporated by reference herein.

FIELD OF THE INVENTION

This document concerns an invention relating generally to exercise devices, and more specifically to exercise devices providing variable lift assistance during such activities as pull-ups and push-ups.

BACKGROUND OF THE INVENTION

Pull-up and push-up exercises often require lifting a substantial portion (if not all) of one's weight using upper body muscles, and fitness novices tend not to have developed the muscles needed to perform such exercises without assistance. As such, individuals wishing to engage in exercise activities or enroll in fitness programs often have difficulty performing repetitions of pull-ups and push-ups on their own. Individuals performing such repetitions usually require varying levels of assistance, and each tends to progress at different rates. In the school setting, for example, physical education teachers often encounter the difficult task of having to assist various students requiring different levels of assistance to complete pull-ups and/or push-ups on their own, while monitoring and evaluating the performance and progress of all students. Current exercise equipment intended to provide assistance during pull-ups tends to be expensive and not portable. What is needed is a low-cost, versatile, and portable exercise device which is easy to use and which provides a variable degree of lift assistance during a variety of exercises.

SUMMARY OF THE INVENTION

The invention, which is defined by the claims set forth at the end of this document, is directed to exercise devices particularly well suited for beginners in training programs and students requiring variable lift assistance. To give the reader a basic understanding of some of the advantageous features of the exercise device, following is a brief summary of preferred versions of the invention, with reference made to the accompanying drawings to enhance the reader's understanding. Because this is merely a summary, it should be understood that more details regarding the preferred versions is found in the Detailed Description set forth elsewhere in this document.

An exemplary device 10 descending from a structure 15 (e.g., a bar, a door frame, etc.) allows a user 20 to insert a body part (e.g., a foot, a waist, etc.) in a loop 300 connected to a lift assistance mechanism 100 that uses a variable number of stretchable resistance members 400 to help reduce the effective weight that the user 20 has to pull up/push up while exercising. Referring initially to FIG. 1, exercise device 10 includes elastic resistance unit 100 suspended from elevated support 15, with elastic members 400 removably and replaceably installed in the elastic resistance unit 100. Each additional elastic member 400 increases the resistance of the elastic resistance unit 100 and thus provides additional lift assistance during pull-ups (see FIGS. 2A and 2B) and push-ups (see FIG. 3). Descending from the elastic resistance unit 100 is a lower loop 305 having an opening which is preferably sized to fit at least the user's 20 foot (for performing, e.g., pull-ups), and an optional secondary loop 310 engaged to the lower loop 305 with a larger opening preferably sized to fit at least the user's 20 waist or upper body (for performing, e.g., push-ups and dips in supine and prone positions).

The elastic resistance unit 100 preferably includes a resistance unit top connector 105 and a resistance unit bottom connector 110, with the elastic members 400 extending therebetween. The resistance unit top and bottom connectors 105, 110 each include several elastic member sockets 115, each elastic member socket 115 having a socket slot 120 opening onto a socket passage 125 that extends the height of the resistance unit top/bottom connector 105/110. Each elastic member 400 may have an elastic elongated portion 410 between two member plugs 405, with the elastic elongated portion 410 unable to pass through the socket slot 120 when unstretched, and the member plugs 405 sized to resist passing through the socket passage 125. An elastic member 400 can thus be installed in the elastic resistance unit 100 by stretching the elastic elongated portion 410 until it is able to pass through socket slots 120, and inserting a portion of each member plug within an elastic member socket 115 (one member plug in each of the resistance unit top and bottom connectors 105, 110).

The elastic resistance unit 100 is preferably suspended to the elevated support 15 via an upper attachment 200, which may include an upper strap 205, a hook (not pictured), or any other adapter engaged to the elevated support 15. If the upper strap 205 is utilized, a fastener (e.g., a side-release buckle 210) may be used to secure ends of the upper strap 205 together to define a loop about the elevated support 15. The side-release buckle 210 may be openable to release the upper strap 205 from the elevated support 15, and closable to secure the upper strap 205 to the elevated support 15. Extending from the upper strap 205, hook, or other adapter may be a cam buckle 220, the cam buckle 220 having top and bottom constricting surfaces 225, 230 spring-biased toward each other. A connecting strap 250 may be held between the two constricting surfaces 225, 230 of the cam buckle 220 to an adjustable length, the connecting strap 250 releasable from the cam buckle 220 by the separation of the two constricting surfaces 225, 230. The connecting strap 250 may fork in a downward direction to opposing sides of the resistance unit top connector 105. The upper attachment 200 is preferably adjustable such that the distance between the elevated support 15 and the resistance unit top connector 105 can be changed, such as by changing the size of the loop formed by the upper strap 205 and fastener 210, or by changing the length of the connecting strap 250 extending through the cam buckle 220.

In using the exercise device 10, the user 20 may insert a foot (or both feet) in the lower loop 305 and lower his or her foot toward the floor, stretching the elastic members 400 in the elastic resistance unit 100. The user 20 may then grip the elevated support 15 with a hand (or both hands) to perform pull-ups by pulling himself or herself up toward the elevated support 15 (see FIG. 2B) and lowering himself or herself back down (see FIG. 2A). Because the elastic members 400 resist being stretched (and the lower loop 305 is thus biased upward when stretched), the elastic resistance unit 100 provides lift assistance during the exercise. For use in performing push-ups, the optional secondary loop 310 may be releasably engaged to the lower loop 305 using a secondary fastener 315 configured to secure opposing ends of the secondary loop 310 together. The user 20 may install the secondary loop 310 about his or her waist or upper body to perform push-ups by pushing on the floor with one or both hands (see FIG. 3). Here, the elastic resistance unit 100 analogously assists the user 20 push himself/herself off the floor during push-up repetitions.

It is noted that the upper strap 205, connecting strap 250, and/or the lower loop 305 may be substantially flat, having a width of at least two centimeters, helping make the exercise device 10 more resistant to spinning (which can lead to tangling of straps), and providing sufficient surface area for supporting body parts.

Further advantages and features of the invention will be apparent from the remainder of this document in conjunction with the associated drawings.

DETAILED DESCRIPTION OF PREFERRED VERSIONS OF THE INVENTION

Figure 1:
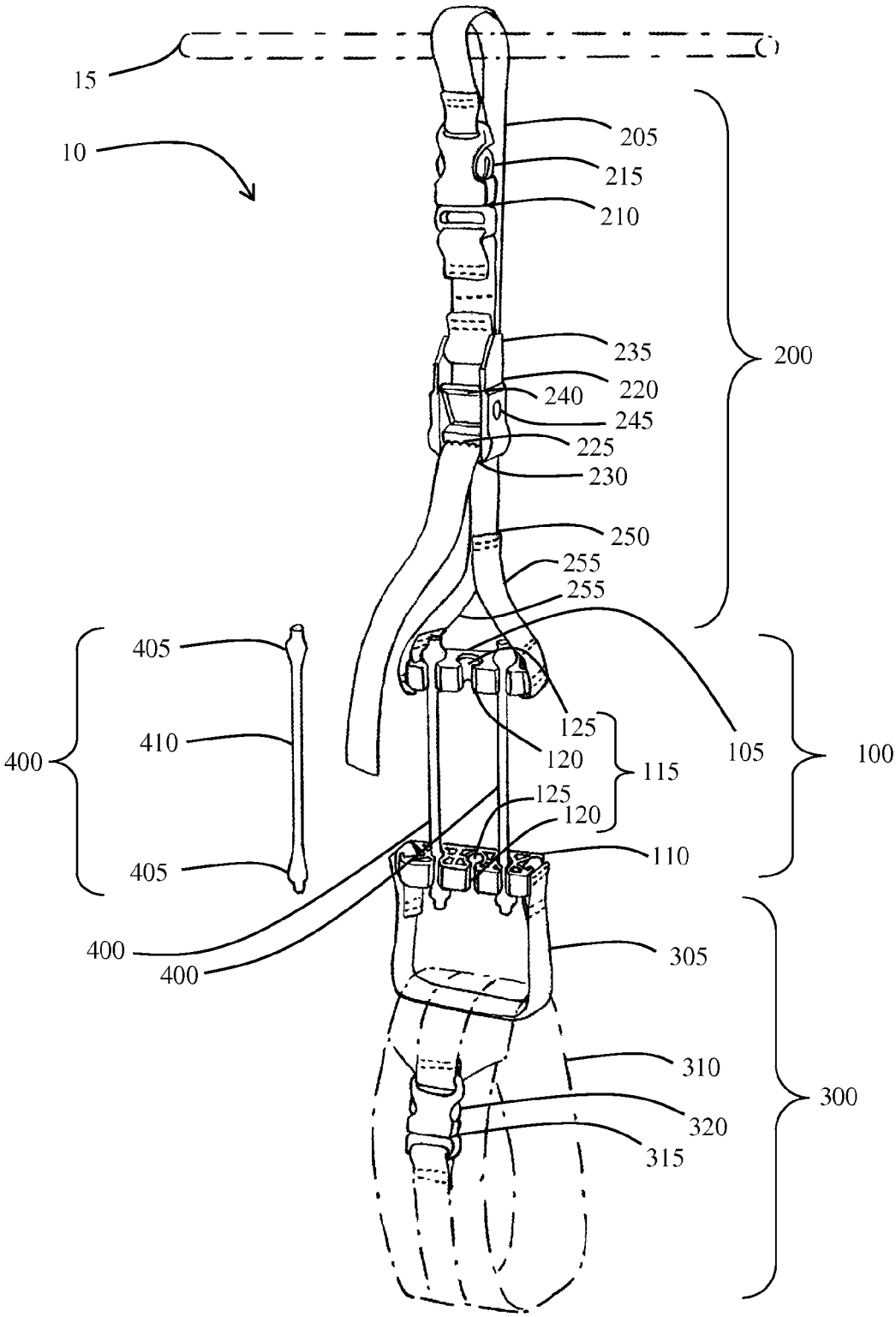
FIG. 1 shows an exemplary exercise device 10 having an elastic resistance unit 100 descending from an elevated support 15 via an upper attachment 200, with two elastic members 400 installed in the elastic resistance unit 100 (and a third elastic member 400 not installed), and with a lower loop 305 and a secondary loop 310 descending from the elastic resistance unit 100.

In the exercise device 10 shown in FIG. 1, the upper attachment 200 includes the upper strap 205 hanging over the bar which serves as the elevated support 15. The upper strap 205 includes the side-release buckle 210 shown in closed configuration, in which a male adapter of fastener 210 is locked into a female adapter of fastener 210 to secure the upper strap 205 to the elevated support 15. To place the side-release buckle 210 in an open configuration, the male and female adapters of the fastener 210 are released from each other by applying pressure to a pair of fastener release tabs 215 on opposing sides of the side-release buckle 210. This detaches the upper attachment 200 from the elevated support 15, allowing the exercise device 10 to be separated therefrom. In both the open and closed configurations of the side-release buckle 210, the upper strap 205 is connected to a cam buckle top side 235. Opposing the cam buckle top side 235 are the top and bottom constricting surfaces 225, 230 which releasably secure the connecting strap 250 therebetween. The top constricting surface 225 is rotatably affixed to the cam buckle 220 via a cam buckle hinge 245, while the bottom constricting surface 230 is a stationary surface of the cam buckle 220. The connecting strap 250 may be released from the cam buckle 220 by pressing on a cam buckle lever 240 to rotate the top constricting surface 225 and separate it from the stationary bottom constricting surface 230. The connecting strap 250 forks into strap arms 255 that connect to opposing sides of the resistance unit top connector 105 to help stabilize the resistance unit top connector 105 by keeping it level. The forked ends of the connecting strap 250 extend up through openings in the resistance unit top connector 105 from the bottom surface to the top surface thereof, and the connecting strap 250 ends are sewn with the connecting strap arms 255 to secure the connecting strap 250 with the resistance unit top connector 105.

The resistance unit top connector 105 is secured to the resistance unit bottom connector 110 by the elastic members 400 (which may be constructed using, e.g., latex) that are installed in the elastic resistance unit 100, but are otherwise not connected thereto. The resistance unit top and bottom connectors 105, 110 have three linearly-arranged elastic member sockets 115 positioned such that the elastic members 400 in the elastic resistance unit 100 are at least substantially parallel with each other when the exercise device 10 is suspended from the elevated support 15. Each elastic member 400 has two member plugs 405 that radially bulge from the long axis of the elastic elongated portion 410 and serve as male connectors. Each elastic member socket 115 serves as a complementary female connector configured to receive a portion of the male member plugs 405, which are at least partially lodged in the elastic member sockets 115 when the elastic members 400 are installed in the elastic resistance unit 100. While the elastic elongated portion 410 is able to pass through the socket slots 120 by being stretched, the male member plugs 405 are preferably not able to pass through the socket slots 120. This helps secure the elastic members 400 in the elastic resistance unit 100 before and during use of the exercise device 10, as well as during storage thereof.

The ends of lower loop 305 may be connected with the resistance unit bottom connector 110 similar to the manner in which the strap arms 255 of the connecting strap 250 are connected with the resistance unit top connector 105. The optional secondary loop 310 is engaged to the lower loop 305 using a secondary side-release buckle 315 similar to the one used with the upper strap 205. This secondary fastener 315 is similarly openable by applying pressure to a pair of secondary fastener release tabs 320 to release the secondary loop 310 from the lower loop 305, and closable to secure the secondary loop 310 with the lower loop 305.

Figure 2A:
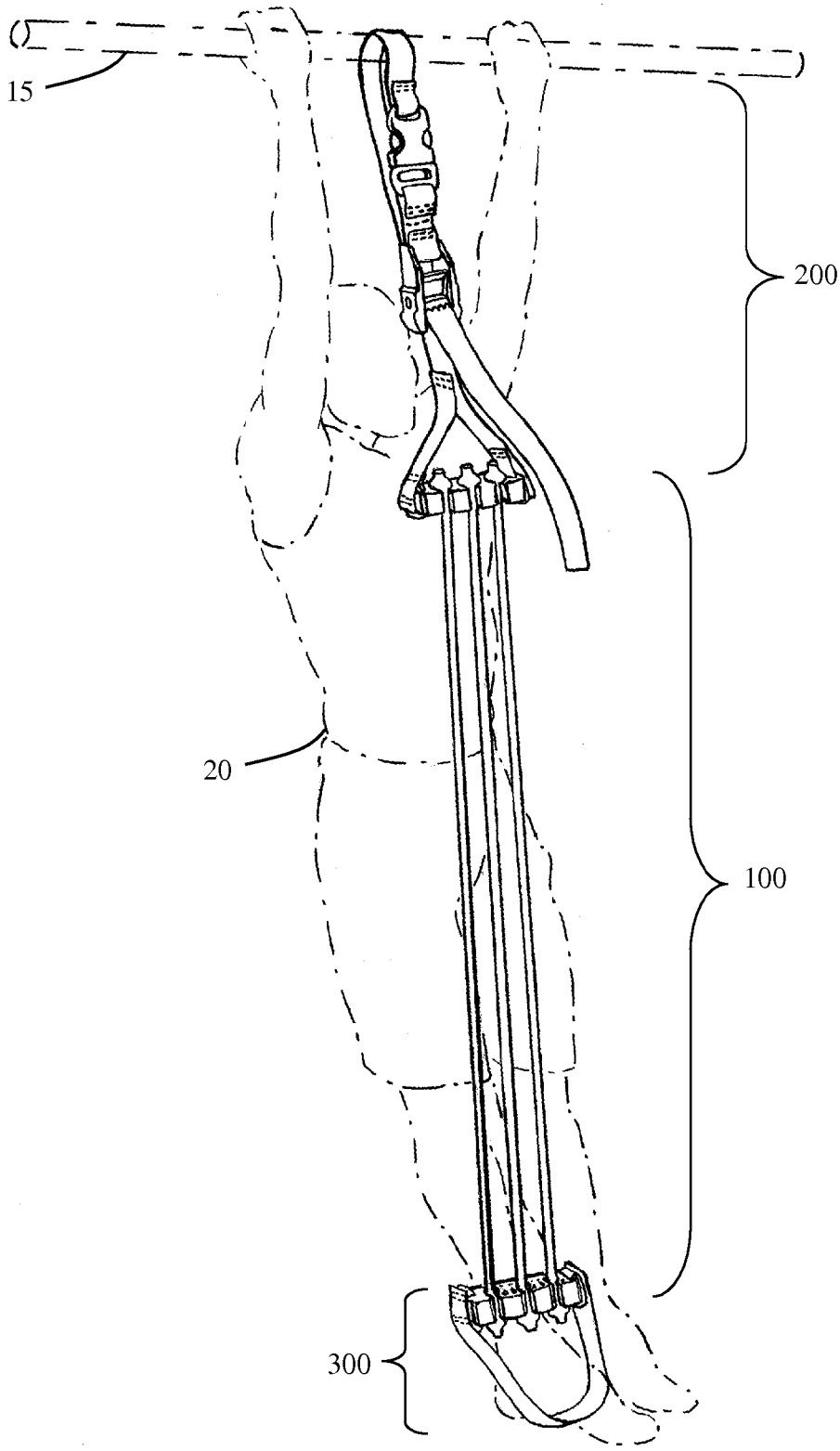
FIG. 2A shows the exercise device 10 of FIG. 1 in use by a user 20 performing a pull-up exercise, the user 20 positioned in the down position of a pull-up repetition while stretching the three elastic members 400 installed in the elastic resistance unit 100.
Figure 2B:
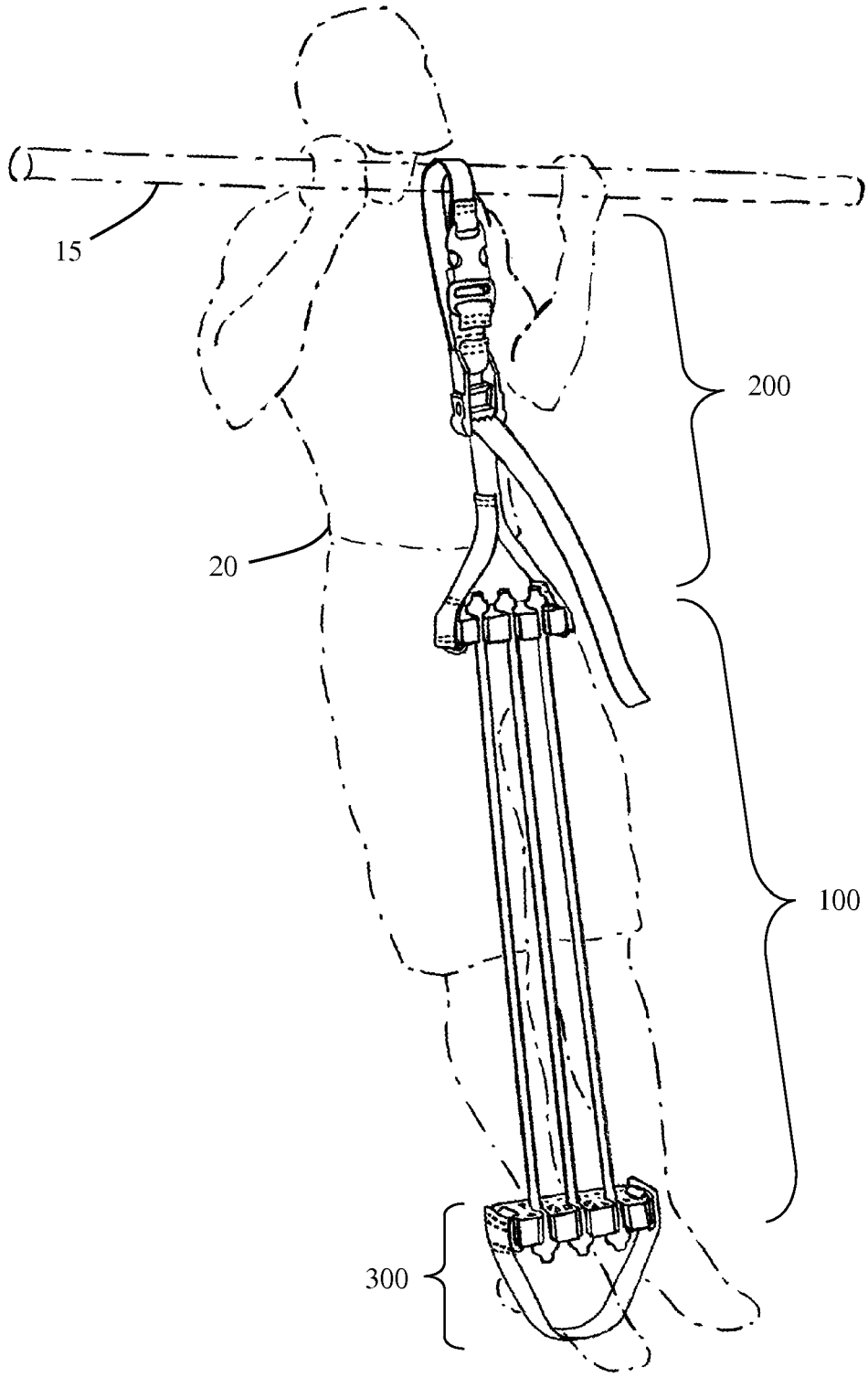
FIG. 2B shows the exercise device 10 of FIG. 1 being used to perform the pull-up exercise of FIG. 2A, with the user 20 in the up position of the pull-up repetition, and the three elastic members 400 stretched to a lesser degree than in the down position of the pull-up repetition.
Figure 3:
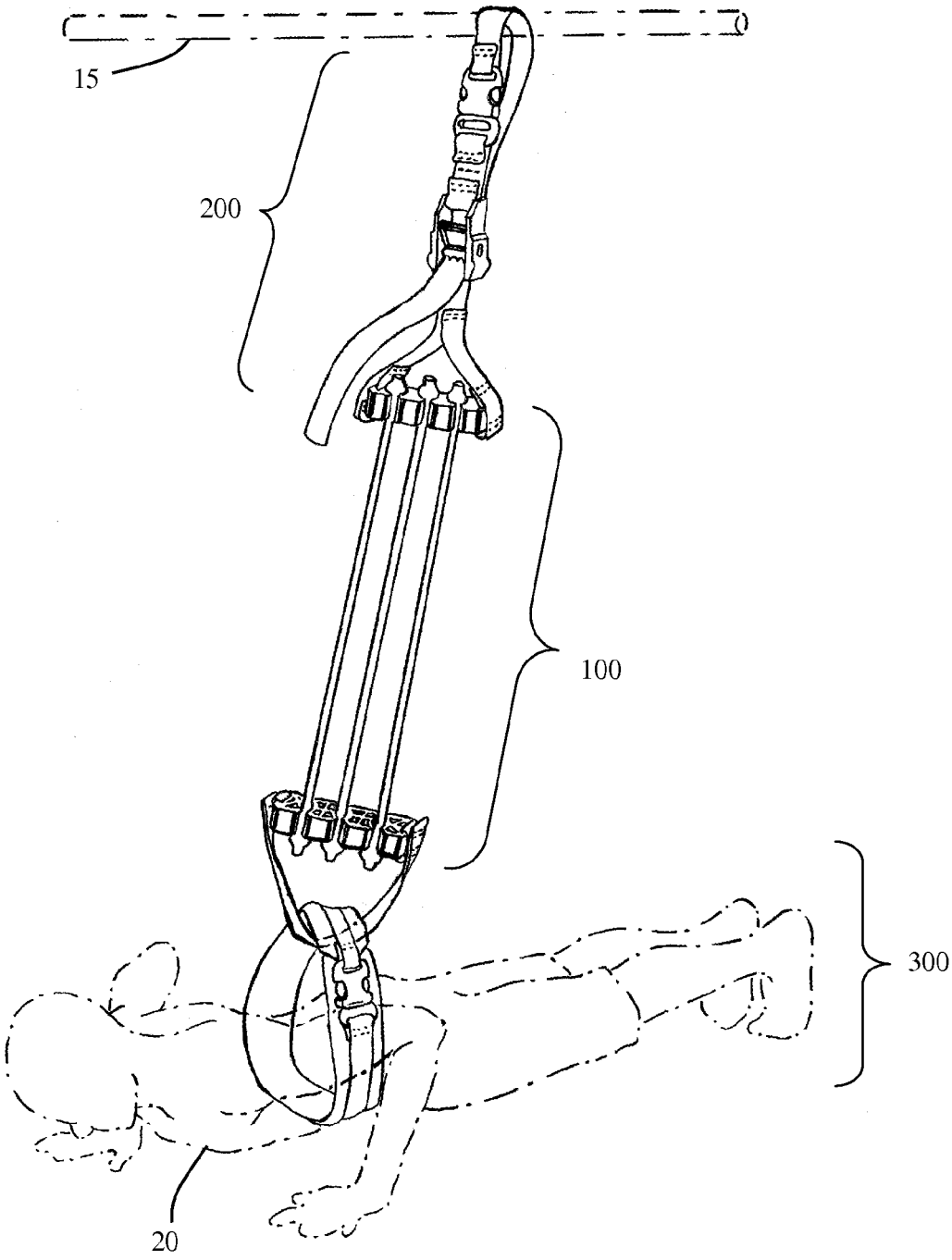
FIG. 3 shows the exercise device 10 of FIG. 1 in use by a user 20 performing a push-up exercise, with the secondary loop 310 about the user's 20 waist/upper body, and the user 20 positioned in the down position of a push-up repetition while stretching the three elastic members 400 installed in the elastic resistance unit 100.

The exercise device 10 depicted in FIG. 1 includes two elastic members 400 installed in the elastic resistance unit 100, with a third elastic member 400 removed from the elastic resistance unit 100 to help better illustrate the elastic member sockets 115. Because the resistance unit top and bottom connectors 105, 110 are biased toward each other when the elastic members 400 installed therebetween are stretched, the level of lift assistance provided by the elastic resistance unit 100 is directly proportional to the number of elastic members 400 installed therein, and directly proportional to each elastic member's 400 resistance to being stretched (that is, indirectly proportional to the elastic member's 400 elasticity). As such, although the exercise device 10 shown in FIGS. 2A, 2B, and 3 is shown with three elastic members 400 installed in the elastic resistance unit 100, any number of elastic members 400 (between one and three), each having any suitable elasticity, can be utilized depending on how much lift assistance is desired. The greater the lift assistance provided by the elastic resistance unit 100, the more of the user's 20 weight is counterbalanced by the exercise device 10, and the easier it is to perform push-up and pull-up exercises.

It is noted that the level of lift assistance provided by the exercise device 10 can be adjusted in other ways as well. For example, by shortening the distance between the elevated support 15 and the resistance unit top connector 105 (such as by adjusting the upper strap 205 and/or by adjusting the connecting strap 250 of the upper attachment 200), the elastic members 400 of the elastic resistance unit 100 are brought closer to the elevated support 15 and are more distanced from the floor. This in effect shortens exercise device 10 relative to the height of user 20, and the elastic members 400 are thus stretched to a greater extent when the user 20 inserts a body part into the lower loop 305 or secondary loop 310. Because the elastic members 400 resist such greater stretching to a relatively larger extent, more lift assistance is provided by the higher tendency of the elastic members 400 to return to their resting state. Further, the level of lift assistance can be increased by increasing the strength of the elastic members 400, such as by adding more latex or other material, to make them thicker (i.e., enlarge their cross-section) and/or otherwise larger. Making the elastic members 400 larger, for example, would not necessarily change their modulus of elasticity, but it would tend to provide them with greater resistance to stretching (and thus greater lift assistance). Furthermore, shorter elastic members 400 installed in the elastic resistance unit 100 would tend to provide greater resistance to stretching than longer elastic members 400 which are otherwise equivalent, providing another way to increase or decrease the lift assistance provided by the elastic resistance unit 100.

It must be kept in mind that the exercise device 10 shown in the accompanying drawings and discussed above are merely exemplary, and may assume a wide variety of configurations different from those noted, and may use components different from those noted, with components connected with/engaged to each other in any suitable manner. It should be understood that the elastic resistance unit 100 may be interposed between a wide variety of components other than the upper attachment 200 and the lower loop 305 shown in FIG. 1. For example, the upper attachment 200 may take any form that is suitable for suspending the exercise device 10 from an anchoring support structure 15. The upper attachment 200 may include webbing without a fastener, or a length of flexible material with opposing fasteners (e.g., mating buckles, or one or more fastek buckles), with the length of webbing or flexible material extending about the bar (or other the elevated support 15). The upper attachment 200 may also utilize (exclusively or in combination with other components) carabiners or other attachments suitable for engaging a bar or other support structure 15.

In alternative versions, the resistance unit bottom connector 110 of the elastic resistance unit 100 may be omitted, as may other components descending from the resistance unit top connector 105 (such as the lower and secondary loops 305, 310). For example, using an elastic resistance unit 100 which incorporates only a resistance unit top connector 105 (without a resistance unit bottom connector 110), both member plugs 405 of one elastic member 400 may be inserted in two elastic member sockets 115 of the resistance unit top connector 105 to form a loop. The user 20 would them be able to insert a body part (such as a foot) into the loop formed by the elastic member 400 and the resistance unit top connector 105, stretching the elastic member 400 down and achieving lift assistance from the elastic member's 400 resistance to being stretched. Such a modification may, in effect, provide the function of lower loop 305 using a resistance unit top connector 105, and an elastic member 400 looped thereon, rather than a strap connected to a resistance unit bottom connector 110, as shown in the figures. Optionally, a protective outer tube, sleeve or partial sleeve, or other cover may be incorporated with the elastic member 400 to provide surface area on which the user 20 may apply pressure. For example, by installing a semicircular, arcuate, or otherwise curved outer tube/sleeve about a portion of the elastic member 400 (the tube/sleeve optionally having an irregular surface intended to provide friction), the user 20 is provided with greater stability and traction when inserting his/her body part in the looped elastic member 400.

In additional versions the upper attachment 200 may be integrated with other known connectors. For example, the upper attachment 200 may incorporate the device described in non-provisional U.S. patent application Ser. No. 12/820,168, filed by Hinds et al. on Jun. 22, 2010, with the title "Strap Attachment Device." The portable strap attachment device disclosed therein includes an upper body curved into a hook (or other appropriate shape) for attachment to the support structure (such as a bar). Extending down from the upper body is a lower body having an opening for a strap, with a cam lever situated at the opening. Based on its position, the cam lever holds or releases the strap, permitting adjustment of the length of the strap that enters the opening. A flexible or translatable gate extending up toward the upper body prevents the curved upper body from inadvertently becoming detached from the support structure. One or both ends of the strap may be connected with the elastic resistance unit 100, such as by being attached to opposing ends of the resistance unit top connector 105 like the connecting strap 250 shown in the figures. Other references, such as U.S. Pat. No. 6,941,620 ("Strap Interconnection Adjusting Assembly") to Hinds shows additional components which may serve as connecting mechanisms incorporated with other versions of the exercise device 10.

It is noted that the resistance unit top and bottom connectors 105, 110 (if both incorporated in the elastic resistance unit 100) are not limited to the connectors pictured in the figures. One or both connectors may be replaced with other components having sockets able to receive elastic members therein. For example, U.S. Pat. Nos. 6,497,641 ("Slotted Exercise Handgrip") and 6,923,750 ("Multiply Slotted Exercise Handgrip") to Hinds show elastic member sockets and handgrips which may be adapted to serve as a bottom connector for the resistance unit and/or a lower loop, or parts thereof. Moreover, elastic members 400 need not be secured to the elastic resistance unit 100 through the insertion of member plugs 405 into the elastic member sockets. Elastic members 400 may be installed in the elastic resistance unit 100 using impingers in a manner shown in, for example, U.S. Pat. Nos. 6,663,544 ("Impinger for Strapped Handgrip") to Hinds and 7,147,592 ("Retained Impinger Handgrip Assembly") to Hinds et al. Additional components which may be interfaced with or incorporated in exemplary versions of the exercise device 10 are shown in, for example, U.S. Pat. Nos. 7,316,636 ("Impinged Retention Exercise Assembly") to Hinds et al. and 7,625,324 ("Keyed Handgrip Assembly") to Hinds et al., as well as U.S. Provisional Applications 61/180,598 ("Plug For Elastic Exercise Cables") filed May 22, 2009, and 61/376,446 ("Suspension Training Device") filed Aug. 24, 2010.

It should also be understood that the exercises shown in FIGS. 2A, 2B, and 3, are merely exemplary, and different exercises performed in a variety of different positions and orientations, and using a variety of different muscles, may be accommodated by one or more exercise devices 10. For example, user 20 may use two or more devices in combination with each other to obtain a desired level of lift assistance through a variety of motions and repetitions. Using two devices 10 suspended from elevated support 15, user 20 may insert one foot in the lower loop 305 of each device 10 to perform pull-up repetitions. It is noted, however, that one benefit of the exercise device 10 is that one convenient device provides variable lift assistance and can accommodate the needs of most users 20.

It should be understood that various terms referring to orientation and position are used throughout this document—e.g., "top" (as in "resistance unit top connector," "cam buckle top side," or "top constricting surface") and "bottom" (as in "resistance unit bottom connector" or "bottom constricting surface")—are relative terms rather than absolute ones. In other words, it should be understood (for example) that the resistance unit top connector can be positioned below the resistance unit bottom connector 110 depending on the overall orientation of the apparatus, and/or the top (rotatable) constricting surface may be located below the bottom (stationary) constricting surface. Thus, such terms should be regarded as words of convenience, rather than limiting terms.

Also in the above description, it is to be understood that such terms as "forward," "rearward," "left," "right," "upwardly," "downwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

The resistance unit top and bottom connectors 105, 110 need not be provided with three linearly-arranged elastic member sockets 115 but rather can have any other configuration that accommodates any desired number of elastic member sockets 115. Also, the resistance unit top and bottom connectors 105, 110 can be identical units or they may have unique shapes and dimensions. For example, a resistance unit bottom connector 110 which is proportionally larger than the resistance unit top connector 105 may be incorporated to provide a larger opening for the lower loop 305 connected to opposing sides of the resistance unit bottom connector 110, or to distance the installed elastic members 400 from each other. The use of different top and bottom connectors may also be used to help provide a convenient visual cue as to which side of the exercise device 10 is suspended from the elevated support 15 and which side hangs down. The elastic member sockets 115 may also be provided with varying shapes and dimensions between the (and/or within each) resistance unit top and bottom connectors 105, 110. As one example, the size of the elastic member socket 115 may be varied to correspond with the member plugs 405 of different elastic members 400 having different elasticities.

The resistance unit top and bottom connectors 105, 110 need not be separate and unattached subunits. They may instead be attached by fixed (that is, non-removable) elastic members extending therebetween, with the option of removably adding a variable number of additional elastic members 400. The fixed elastic members would provide the elastic resistance unit 100 with a minimum level of resistance (and thus lift assistance) which can be increased by installing a desired number of additional elastic members 400. The fixed elastic members would also integrate the subunits of the elastic resistance unit 100, helping avoid one or both from being lost or misplaced.

The lower loop 305 can be configured to be resizable such that it can be adjusted to fit body parts of varying sizes not limited to feet (such as the waist or torso). Such a lower loop 305 may be usable for push-ups without being engaged to the secondary loop 310 having a larger opening.

Further, while this document has generally discussed the use of elastic members 400 in the form of elastic tubes made of latex, they may be replaced by, for example, elastic cords, elastic straps (such as flat bands having rectangular cross-sections and able to be tied about themselves or other objects), springs (made of, e.g., steel or other materials), or the like.

Prior patents, patent applications, and other documents noted in the foregoing discussion should be regarded as incorporated by reference, such that the contents of these documents also effectively define contents of this document.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. An exercise device for providing lift assistance including:

a) an elastic resistance unit suspended from an elevated support via an upper attachment, the elastic resistance unit having a resistance unit top connector and a resistance unit bottom connector, wherein:

1) the upper attachment:

(i) is adjustable such that the distance between the elevated support and the resistance unit top connector can be changed; and (ii) includes:

(a) a hook extending from a cam buckle, (1) the cam buckle having two constricting surfaces spring-biased toward each other, (2) the hook being suspended from the elevated support; and (b) a connecting strap adjustably extending between the constricting surfaces of the cam buckle, the connecting strap connected to opposing sides of the resistance unit top connector;

2) the resistance unit top and bottom connectors each have one or more elastic member sockets, (i) each elastic member socket having a socket slot opening onto a socket passage, (ii) each socket passage extending between top and bottom surfaces of the resistance unit top and bottom connectors; and 3) the elastic resistance unit is configured to removably receive one or more elastic members between corresponding elastic member sockets of the resistance unit top and bottom connectors, wherein receivable elastic members:

(i) have an elastic elongated portion between two member plugs, the member plugs being configured to resist passing through the socket passages of the elastic member sockets; and (ii) are installable in the elastic resistance unit by having a portion of each member plug thereof inserted within corresponding elastic member sockets; and b) a lower loop descending from the resistance unit bottom connector of the elastic resistance unit, the lower loop having an opening sized to receive at least a user's foot.

2. The exercise device of claim 1 wherein the upper attachment includes an upper strap having a fastener, the fastener configured to secure ends of the upper strap together to define a loop about the elevated support.

3. The exercise device of claim 2 wherein the fastener is a side-opening buckle configured to be a) openable to release the upper attachment from the elevated support, and b) closable to secure the upper attachment to the elevated support.

4. The exercise device of claim 1 wherein the elastic elongated portion cannot pass through the socket slot when unstretched.

5. The exercise device of claim 1 further including a secondary loop engaged to the lower loop, the lower loop and the secondary loop each having an opening defined therein, wherein the secondary loop has a larger opening than the lower loop.

6. A method of using the exercise device of claim 1 including the steps of:

a) installing one or more elastic members between the resistance unit top connector and the resistance unit bottom connector by:

1) stretching each elastic elongated portion and passing it through each pair of socket slots, and 2) inserting at least a portion of each pair of member plugs within corresponding elastic member sockets;

b) inserting a foot through the lower loop and stretching the one or more elastic members;

c) gripping the elevated support using a hand; and d) performing a pull-up having an upward motion and a downward motion using the elastic resistance of the elastic members to provide lift assistance.

7. A method of using the exercise device of claim 1, the exercise device further including a secondary loop engaged to the lower loop, the lower loop and the secondary loop each having an opening defined therein, the method including the steps of:

a) installing an elastic member between the resistance unit top connector and the resistance unit bottom connector;

b) installing the secondary loop about a user's waist or upper body; and c) performing an exercise by pushing on the floor.

8. An exercise device for providing lift assistance including:

a) an elastic resistance unit suspended from an elevated support via an upper attachment, the elastic resistance unit having a resistance unit top connector and a resistance unit bottom connector, wherein:

1) the upper attachment:

(i) is adjustable such that the distance between the elevated support and the resistance unit top connector can be changed; and (ii) includes:

(a) an upper strap having a fastener, the fastener configured to secure ends of the upper strap together to define a loop about the elevated support;

(b) a cam buckle affixed to the upper strap; and (c) a connecting strap affixed to the resistance unit top connector, the connecting strap extending through the cam buckle, whereby the connecting strap can be adjustably affixed within the cam buckle to adjust the length between the elevated support and the resistance unit top connectors 2) the resistance unit top and bottom connectors each have one or more elastic member sockets, (i) each elastic member socket having a socket slot opening onto a socket passage, (ii) each socket passage extending between top and bottom surfaces of the resistance unit top and bottom connectors; and 3) the elastic resistance unit is configured to removably receive one or more elastic members between corresponding elastic member sockets of the resistance unit top and bottom connectors, wherein receivable elastic members:

(i) have an elastic elongated portion between two member plugs, the member plugs being configured to resist passing through the socket passages of the elastic member sockets; and (ii) are installable in the elastic resistance unit by having a portion of each member plug thereof inserted within corresponding elastic member sockets; and b) a lower loop descending from the resistance unit bottom connector of the elastic resistance unit, the lower loop having an opening sized to receive at least a user's foot.

9. The exercise device of claim 8 wherein the connecting strap is affixed within the cam buckle by being pressed between two cam buckle surfaces, the cam buckle surfaces being spring-biased toward each other.

10. An exercise device for providing lift assistance, a) the exercise device including:

1) an upper attachment configured to suspend the exercise device from an elevated support;

b) an elastic resistance unit affixed to the upper attachment, (i) the elastic resistance unit having a resistance unit top connector with two or more upper elastic member sockets, and a resistance unit bottom connector with two or more lower elastic member sockets, wherein the upper attachment is adjustable such that the distance between the elevated support and the resistance unit top connector is changeable;

(ii) each elastic member socket having a socket passage extending between top and bottom surfaces of the resistance unit top and bottom connectors; and 3) one or more elastic members removably and replaceably installed in the elastic resistance unit between the upper and lower elastic member sockets, (i) each elastic member having two member plugs, each member plug configured to resist passing through the socket passages of the elastic member sockets, (ii) each elastic member installed in the elastic resistance unit by having a portion of each member plug thereof inserted within corresponding elastic member sockets;

b) wherein the upper attachment includes a cam buckle and a connecting strap, with:

1) an adjustable length of the connecting strap extending through the cam buckle; and 2) the connecting strap forking in a downward direction to opposing sides of the resistance unit top connector.

11. The exercise device of claim 10 further including a lower loop having opposing ends extending from opposing sides of the resistance unit bottom connector, the lower loop formed of a strap having a width of approximately two centimeters or greater.

12. The exercise device of claim 10 wherein:

a) each elastic member socket further includes a socket slot opening onto the socket passage, and b) each elastic member extending between each pair of upper and lower elastic member sockets includes an elastic elongated portion between the two member plugs, the elastic elongated portion resistant to passing through the socket slot when unstretched.

13. The exercise device of claim 10 wherein:

a) the upper attachment includes an openable and closable fastener and an upper loop defined by one or more straps, the fastener being operable to open the upper loop and closable to close the upper loop, and b) the fastener is a side-opening buckle between the elevated support and a cam buckle.

14. The exercise device of claim 10 wherein the connecting strap has a width of at least two centimeters.

15. An exercise device for providing lift assistance including:

a) an upper attachment configured to be suspended from an elevated support, the upper attachment having:

1) a hook configured to secure the exercise device to the elevated support;

2) a cam buckle descending from the hook, the cam buckle including first and second constricting surfaces spring-biased toward each other;

3) a connecting strap adjustably extending from the cam buckle, the connecting strap secured to the cam buckle by being pressed between the constricting surfaces of the cam buckle; and b) an elastic resistance unit secured to the connecting strap, 1) the elastic resistance unit having a resistance unit top connector with at least two upper elastic member sockets, 2) each upper elastic member socket having a socket slot opening onto a socket passage, each socket slot and each socket passage extending between top and bottom surfaces of the resistance unit top connector; and c) one or more elastic members installed in the elastic resistance unit, 1) each elastic member having an elastic elongated portion between two member plugs, the member plugs being configured to resist passing through the socket passages of the elastic member sockets, 2) each elastic member having a portion of at least one member plug thereof removably inserted in the upper elastic member sockets of the resistance unit top connector.

16. The exercise device of claim 15 wherein:

a) the elastic resistance unit further includes a resistance unit bottom connector having at least two lower elastic member sockets, 1) each lower elastic member socket having a socket slot opening onto a socket passage, 2) each socket slot and each socket passage extending between top and bottom surfaces of the resistance unit top connector; and b) at least one of the elastic members has one member plug installed in one of the upper elastic member sockets and another member plug installed in one of the lower elastic member sockets.

17. The exercise device of claim 16 further including a lower loop having opposing ends attached to opposing sides of the resistance unit bottom connector, the lower loop having an opening sized to receive at least a user's foot.

18. The exercise device of claim 17 wherein:

a) the elastic elongated portion is sized to resist passing through the socket slot when unstretched, b) each of the connecting strap and the lower loop 1) is an at least substantially flat strap, and 2) has a width of at least two centimeters.

19. The exercise device of claim 18 further including a secondary loop releasably engaged to the lower looped strap, the secondary loop having a secondary fastener configured to secure opposing ends of the secondary loop together, wherein:

a) the lower looped strap and the secondary loop each have an opening defined therein, and b) the secondary loop has a larger opening than the lower looped strap, the opening of the secondary loop sized to receive at least a user's waist.

20. The exercise device of claim 15 wherein the exercise device is configured to:

a) receive at least a user's foot; and b) provide lift assistance as the user's foot exerts downwardly force on at least a portion of one of the elastic members when the exercise device is secured to the elevated support.

21. An exercise device for providing lift assistance, a) the exercise device including an elastic resistance unit configured to be suspended from an elevated support via an upper attachment, the elastic resistance unit having a resistance unit top connector and a resistance unit bottom connector;

b) wherein:

1) the upper attachment includes:

(i) a hook extending from a cam buckle, (a) the hook being configured to secure the exercise device to the elevated support, (b) the cam buckle having two constricting surfaces spring-biased toward each other; and (ii) a connecting strap passing between the constricting surfaces of the cam buckle and secured to the resistance unit top connector, wherein the connecting strap is configured to be adjustably secured within the cam buckle to allow adjustment of the distance between the elevated support and the resistance unit top connector;

2) the resistance unit top and bottom connectors each have one or more elastic member sockets, (i) each elastic member socket having a socket slot opening onto a socket passage, (ii) each socket passage extending between top and bottom surfaces of the resistance unit top and bottom connectors;

3) the elastic resistance unit is configured to removably receive one or more elastic members between elastic member sockets of the resistance unit top and bottom connectors; and 4) the exercise device is configured to receive at least a user's foot and provide lift assistance as the resistance unit bottom connector experiences downwardly force.

22. The exercise device of claim 21 wherein the connecting strap is connected to opposing sides of the resistance unit top connector.

23. The exercise device of claim 21 further including a lower loop secured at least in part to the resistance unit bottom connector, the lower loop configured to provide lift assistance to a user.

24. An exercise device for providing lift assistance including:

a) an upper attachment configured to be suspended from an elevated support, the upper attachment having:

1) a hook extending from a cam buckle, (i) the hook being configured to secure the exercise device to the elevated support, (ii) the cam buckle including first and second constricting surfaces spring-biased toward each other; and 2) a connecting strap secured to the cam buckle by being pressed between the constricting surfaces of the cam buckle, the connecting strap and cam buckle configured to allow the distance between the elevated support and the resistance unit top connector to be adjusted;

b) a resistance unit top connector descending from the connecting strap, 1) the resistance unit top connector having at least one upper elastic member socket, 2) each upper elastic member socket having a socket slot opening onto a socket passage, each socket slot and each socket passage extending between top and bottom surfaces of the resistance unit top connector; and c) one or more elastic members installed in the resistance unit top connector, 1) each elastic member having an elastic elongated portion between two member plugs, the member plugs being configured to resist passing through the socket passages of the elastic member sockets, 2) each elastic member having a portion of at least one member plug thereof removably inserted in the upper elastic member sockets of the resistance unit top connector.

25. The exercise device of claim 24 wherein the exercise device is configured to:

a) receive at least a user's foot; and b) provide lift assistance as the user exerts downwardly force on at least a portion of one of the elastic members.

26. The exercise device of claim 24 further including a lower loop positioned below the resistance unit top connector, wherein:

a) the lower loop is configured to receive at least a user's foot; and b) the exercise device is configured to provide lift assistance as the lower loop descends away from the elevated support.

27. The exercise device of claim 24 further including a resistance unit bottom connector having at least one lower elastic member socket, a) each lower elastic member socket having a socket slot opening onto a socket passage, b) each socket slot and each socket passage extending between top and bottom surfaces of the resistance unit bottom connector, c) wherein each installed elastic member extends between one of the upper elastic member sockets and one of the lower elastic member sockets.

* * * * *